US009482178B2

(12) United States Patent
Batta

(10) Patent No.: US 9,482,178 B2
(45) Date of Patent: Nov. 1, 2016

(54) CYLINDER LINER WITH AN UNDERCUT SEAL TRAP

(71) Applicant: Caterpillar Inc., Peoria, IL (US)

(72) Inventor: Christopher Batta, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 128 days.

(21) Appl. No.: 14/462,924

(22) Filed: Aug. 19, 2014

(65) Prior Publication Data

US 2016/0053707 A1 Feb. 25, 2016

(51) Int. Cl.

| | |
|---|---|
| ***F02F 1/00*** | (2006.01) |
| ***F02F 11/00*** | (2006.01) |
| ***F02F 1/16*** | (2006.01) |
| *F02F 3/00* | (2006.01) |

(52) U.S. Cl.

CPC ..... *F02F 1/004* (2013.01); *F02F 1/163* (2013.01); *F02F 11/005* (2013.01); *F02F 3/00* (2013.01)

(58) Field of Classification Search

CPC ..... F02F 1/004; F02F 11/005; F02F 1/16; F02F 1/163

USPC ..... 123/193.2, 193.3, 668, 669; 29/888.061; 277/313, 591

See application file for complete search history.

(56) References Cited

U.S. PATENT DOCUMENTS 3,340,774 A 9/1967 Brenneke
3,403,661 A * 10/1968 Valentine ..... F02F 1/16 123/41.84
3,906,923 A * 9/1975 Harker ..... F02F 3/10 123/193.4
3,942,807 A * 3/1976 Dinger ..... F02F 11/002 123/41.84
4,099,725 A * 7/1978 Wolters ..... F02F 11/005 123/193.3
4,244,330 A * 1/1981 Baugh ..... F01M 11/02 123/193.2
4,417,549 A * 11/1983 Kazenmaier ..... F02F 1/16 123/41.84
4,505,234 A * 3/1985 Meiners ..... F02F 1/16 123/193.2
5,357,921 A * 10/1994 Katoh ..... B22D 19/0009 123/193.2
5,967,109 A * 10/1999 Bruce ..... F02F 1/16 123/193.2
6,167,847 B1 * 1/2001 Ergezen ..... F02F 1/16 123/41.79
6,367,848 B1 * 4/2002 Bruce ..... F02F 1/16 123/193.2
6,532,915 B2 * 3/2003 Thompson ..... F16J 15/062 123/41.74
6,732,699 B2 * 5/2004 Wakade ..... F02F 1/004 123/193.2
6,931,705 B2 8/2005 Kueltzo et al.
7,438,038 B2 * 10/2008 Azevedo ..... F02F 1/163 123/193.2
2011/0139113 A1 * 6/2011 Miller ..... F02F 1/16 123/193.3
2013/0206124 A1 * 8/2013 Quinton ..... F02F 1/16 123/669

* cited by examiner

*Primary Examiner* — Grant Moubry
(74) *Attorney, Agent, or Firm* — Baker & Hostetler LLP

(57) ABSTRACT

A cylinder liner for an engine includes a cylindrical wall having a radially internal surface and a radially external surface opposite the radially internal surface, the cylindrical wall defining a longitudinal axis therethrough, the radially external surface including a sealing surface and an undercut surface adjacent to the sealing surface, the sealing surface at least partly facing away from the longitudinal axis. The undercut surface includes a first surface and a second surface, the first surface at least partly facing the longitudinal axis, and the second surface at least partly facing away from the longitudinal axis.

18 Claims, 5 Drawing Sheets

CYLINDER LINER WITH AN UNDERCUT SEAL TRAP

TECHNICAL FIELD

This patent disclosure relates generally to cylinder liners for reciprocating engines or compressors and, more particularly, to cylinder liners including an undercut seal trap.

BACKGROUND

Reciprocating piston engines are known for converting either fluid energy, from a steam source, for example, or chemical energy, from a combustible fuel source, for example, into mechanical shaft power. Reciprocating piston compressors are known for converting shaft power into fluid energy by compressing a fluid therein. A variable volume chamber of a reciprocating engine or compressor may be defined at least in part by a cylindrical wall surrounding a piston. The cylindrical wall may be integral with a block of the engine or compressor, or alternatively, the cylindrical wall may be included as part of a removable cylinder liner.

A removable cylinder liner may include sealing features to promote sealing of a working fluid within the variable volume chamber, to promote sealing of a coolant within a coolant passage in fluid communication with the cylinder liner, or combinations thereof. Sealing elements may be disposed between the cylinder liner and other engine structures, such as a block or head of the engine, to accomplish one or more of the desired sealing functions.

U.S. Pat. No. 6,532,915 ("the '915 patent"), entitled "Sealing Arrangement for a Cylinder Liner," addresses the problem of potential damage to a cylinder liner seal by sharp edges or burrs on a bore of an engine block while pressing the cylinder liner into the bore of the engine block. The '915 patent describes a cylinder liner with an annular groove for containing a seal. The annular groove of the '915 patent includes a first undercut at an upper portion of the annular groove and a second undercut at a lower portion of the annular groove.

However, the sealing arrangement described in the '915 patent may not be optimum for all configurations of incorporating a cylinder liner into an engine, all seal configurations, or combinations thereof. Accordingly, there is a need for improved cylinder liners to address one or more of the problems set forth above, and/or other problems in the art.

SUMMARY

According to an aspect of the disclosure, a cylinder liner for an engine includes a cylindrical wall having a radially internal surface and a radially external surface opposite the radially internal surface, the cylindrical wall defining a longitudinal axis therethrough, the radially external surface including a sealing surface and an undercut surface adjacent to the sealing surface, the sealing surface at least partly facing away from the longitudinal axis. The undercut surface includes a first surface and a second surface, the first surface at least partly facing the longitudinal axis, and the second surface at least partly facing away from the longitudinal axis.

According to another aspect of the disclosure, a cylinder liner assembly includes a cylindrical wall having a radially internal surface and a radially external surface opposite the radially internal surface, the cylindrical wall defining a longitudinal axis therethrough, the radially external surface including a sealing surface and an undercut surface adjacent to the sealing surface, the sealing surface at least partly facing away from the longitudinal axis, and a seal disposed on the sealing surface. The undercut surface includes a first surface and a second surface, the first surface at least partly facing the longitudinal axis, and the second surface at least partly facing away from the longitudinal axis.

According to another aspect of the disclosure, an engine includes a block; a cylinder liner disposed within the block; a radially external surface of the cylinder liner at least partly facing the block, the cylinder liner defining a longitudinal axis therethrough; a piston disposed within the cylinder liner and configured for reciprocal sliding engagement with a radially internal surface of the cylinder liner along the longitudinal axis, the radially internal surface being opposite the radially external surface, the radially external surface of the cylinder liner including a sealing surface and an undercut surface adjacent to the sealing surface, the sealing surface at least partly facing away from the longitudinal axis, and a seal disposed in sealing engagement with the sealing surface and the block. The undercut surface includes a first surface and a second surface, the first surface at least partly facing the longitudinal axis, and the second surface at least partly facing away from the longitudinal axis.

DETAILED DESCRIPTION

Figure 1:
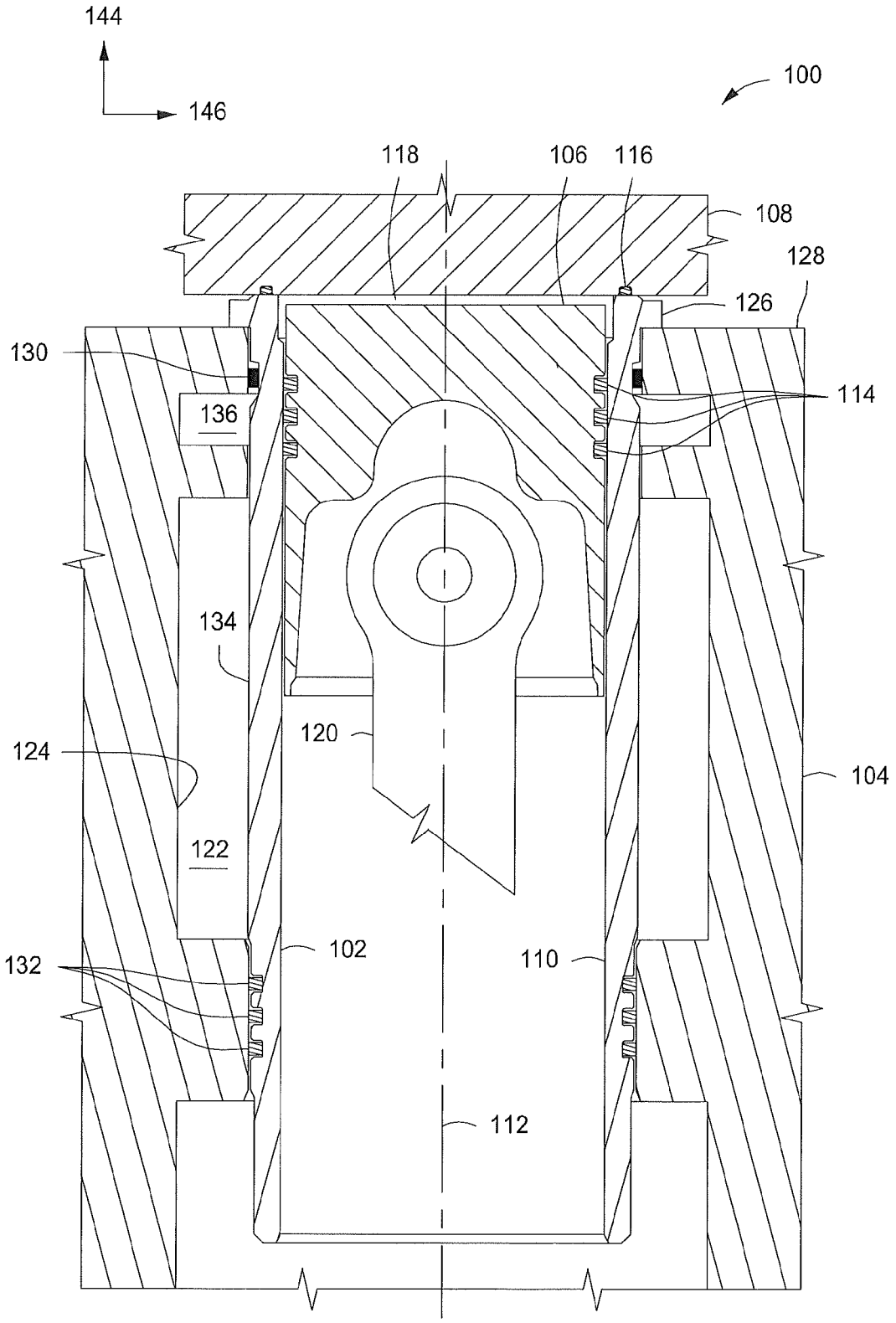
FIG. 1 shows a schematic cross sectional view of an engine, according to an aspect of the disclosure.

Aspects of the disclosure will now be discussed with reference to the several drawings, wherein like reference numbers refer to like elements throughout, unless specified otherwise. FIG. 1 shows a schematic cross sectional view of an engine 100, according to an aspect of the disclosure. Engine 100 includes a cylinder liner 102, a block 104, a piston 106, and a head 108. The piston 106 is disposed within a radially internal surface 110 of the cylinder liner 102, and configured to reciprocate within the cylinder liner 102 along a longitudinal axis 112 defined by the cylinder liner 102. The piston 106 may engage the radially internal surface 110 of the cylinder liner 102 through one or more piston rings 114 disposed about a circumference of the piston 106. Although only one piston 106 and cylinder liner 102 assembly is shown in FIG. 1, it will be appreciated that the engine 100 may include any number of pistons 106 and cylinder liners 102 to yield desired results in a particular application.

The head 108 may bear on an upper end of the cylinder liner 102, and a seal 116 may be disposed therebetween. Accordingly, the piston 106, the piston rings 114, the radially internal surface 110 of the cylinder liner 102, and the head 108 may define a variable volume chamber 118. In steam engines, and the like, the variable volume chamber 118 may be a steam expansion chamber. In reciprocating compressors, and the like, the variable volume chamber 118 may be a fluid compression chamber. In internal combustion engines, and the like, the variable volume chamber 118 may be a combustion chamber wherein a fuel-oxidizer mixture is burned. The piston 106 may be reciprocally connected to a crankshaft (not shown) via a connecting rod 120, or other approach for connecting a piston to a crankshaft known in the art. Although not shown in FIG. 1, it will be appreciated that the head 108 may contain one or more intake and exhaust passages, as well as one or more intake and exhaust valves, for admitting fluid into the variable volume chamber 118 and exhausting fluid from the variable volume chamber 118.

The cylinder liner 102 is disposed within a bore 122 defined by an internal surface 124 of the block 104. A flange 126 of the cylinder liner 102 may bear on an upper deck surface 128 of the block 104. Further, the cylinder liner 102 may engage the internal surface 124 of the block 104 through an upper seal 130, a lower seal 132, or combinations thereof. Although FIG. 1 shows the upper seal 130 including one sealing element, and the lower seal 132 including three sealing elements, it will be appreciated that either the upper seal 130 or the lower seal 132 may include one or more sealing elements as desired for a particular application.

The internal surface 124 of the block 104, a radially external surface 134 of the cylinder liner 102, the upper seal 130, and the lower seal 132 may define, at least in part, a cavity 136. According to an aspect of the disclosure, the cavity 136 effects fluid communication between a coolant source and the radially external surface 134 of the cylinder liner 102, thereby providing means for removing heat from the cylinder liner 102, the block 104, or combinations thereof. According to another aspect of the disclosure, the cavity 136 effects fluid communication between a lubricating oil source and the radially external surface 134 of the cylinder liner 102. Although only one cavity 136 is shown in FIG. 1, it will be appreciated that the radially external surface 134 of the cylinder liner 102 may define, at least in part, more than one cavity 136 in fluid communication with the cylinder liner 102.

Figure 2:
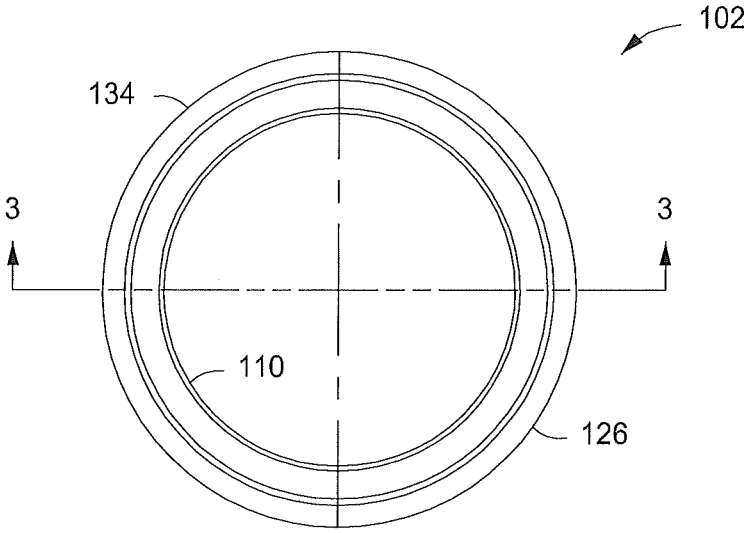
FIG. 2 shows a top view of a cylinder liner, according to an aspect of the disclosure.
Figure 3:
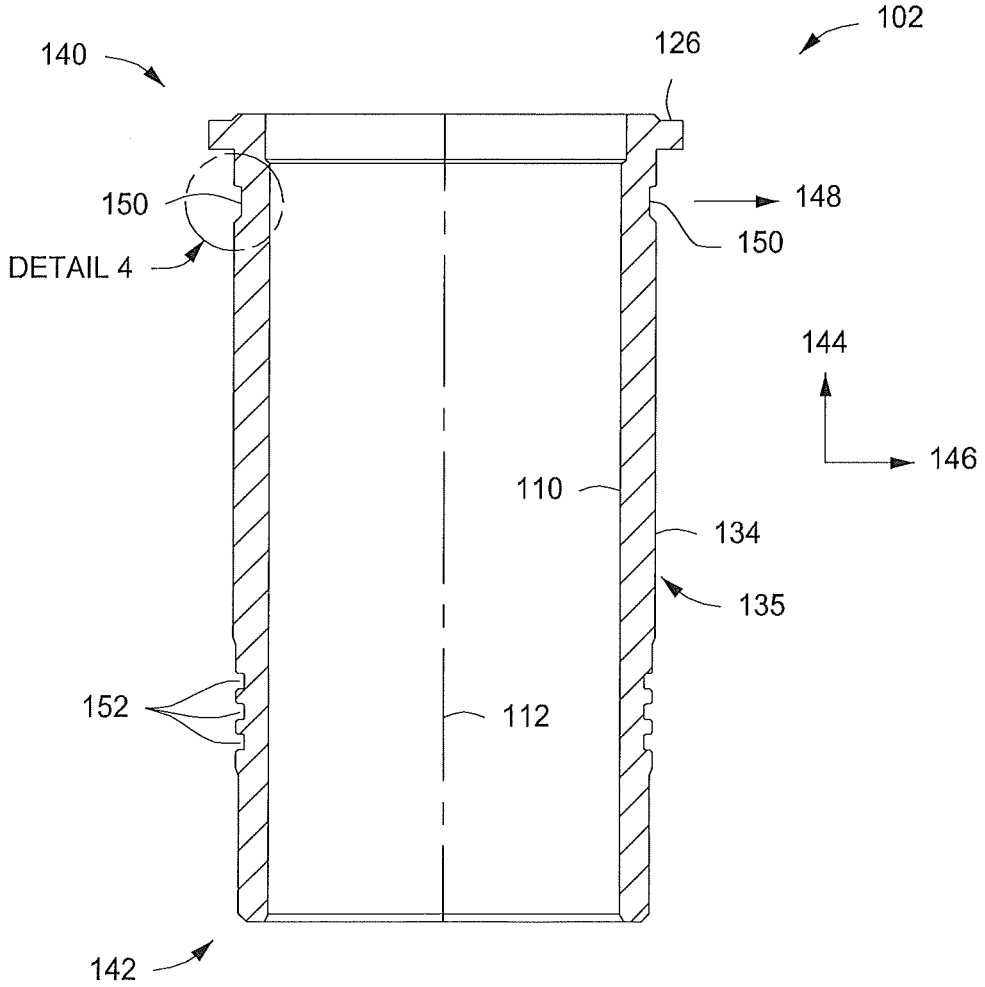
FIG. 3 shows a side cross sectional view of the cylinder liner from FIG. 2 along section 3-3, according to an aspect of the disclosure.

Referring now to FIGS. 2 and 3, it will be appreciated that FIG. 2 shows a top view of a cylinder liner 102, according to an aspect of the disclosure; and FIG. 3 shows a side cross sectional view of the cylinder liner 102 from FIG. 2 along section 3-3, according to an aspect of the disclosure. The radially internal surface 110 may extend from a proximal end 140 of the cylinder liner 102 to a distal end 142 of the cylinder liner along a longitudinal direction 144 that is parallel to the longitudinal axis 112. The radially external surface 134 may extend from the proximal end 140 of the cylinder liner 102 to the distal end 142 of the cylinder liner along the longitudinal direction 144. The radially external surface 134 and the radially internal surface 110 define a cylindrical wall 135 therebetween. According to an aspect of the disclosure, the cylindrical wall 135 has a generally circular cylindrical shape. A radial direction 146 extends normal to or perpendicular to the longitudinal direction 144.

The radially external surface 134 of the cylinder liner 102 includes an upper sealing surface 150, configured to receive and/or bear on the upper seal 130, and may include one or more lands 152 configured to receive and/or bear on the lower seal 132. The upper sealing surface 150 may be disposed between the flange 126 and the one or more lands 152 along the longitudinal direction 144. Further, the upper sealing surface 150 may be disposed closer to the proximal end 140 of the cylinder liner 102 than the one or more lands 152 along the longitudinal direction 144. The upper sealing surface 150 is disposed proximate to the flange 126 along the longitudinal direction 144.

The upper sealing surface 150 faces at least partly away from the longitudinal axis 112 along the radial direction 146. The upper sealing surface 150 may at least partly face away from the longitudinal axis 112 in the radial direction 146 at least because no radial component of the vector 148, extending perpendicular to the upper sealing surface 150, points toward the longitudinal axis 112. According to an aspect of the disclosure, the vector 148 extending perpendicular to the upper sealing surface 150 points exclusively in the radial direction 146 away from the longitudinal axis 112. Although the upper sealing surface 150 shown in FIG. 4 has having a flat or linear profile in the plane defined by the longitudinal direction 144 and the radial direction 146, it will be appreciated that the upper sealing surface 150 could alternatively or additionally assume other profiles in the plane defined by the longitudinal direction 144 and the radial direction 146, including but not limited to, convex profiles, concave profiles, combinations thereof, or any other sealing surface profile known to persons having skill in the art.

Figure 4:
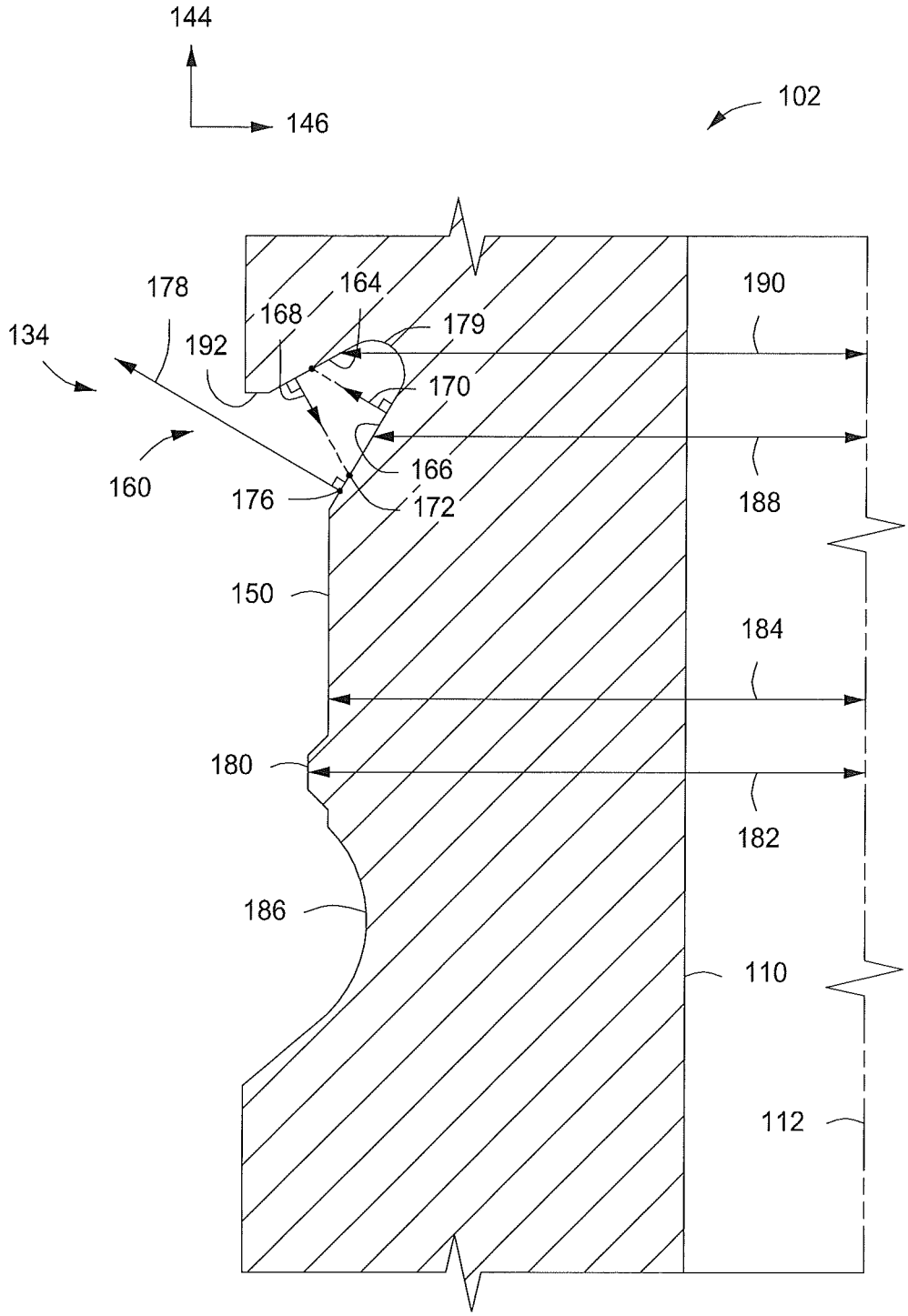
FIG. 4 shows a cross sectional view of a portion of the cylinder liner annotated as Detail 4 in FIG. 3, according to an aspect of the disclosure.
Figure 6:
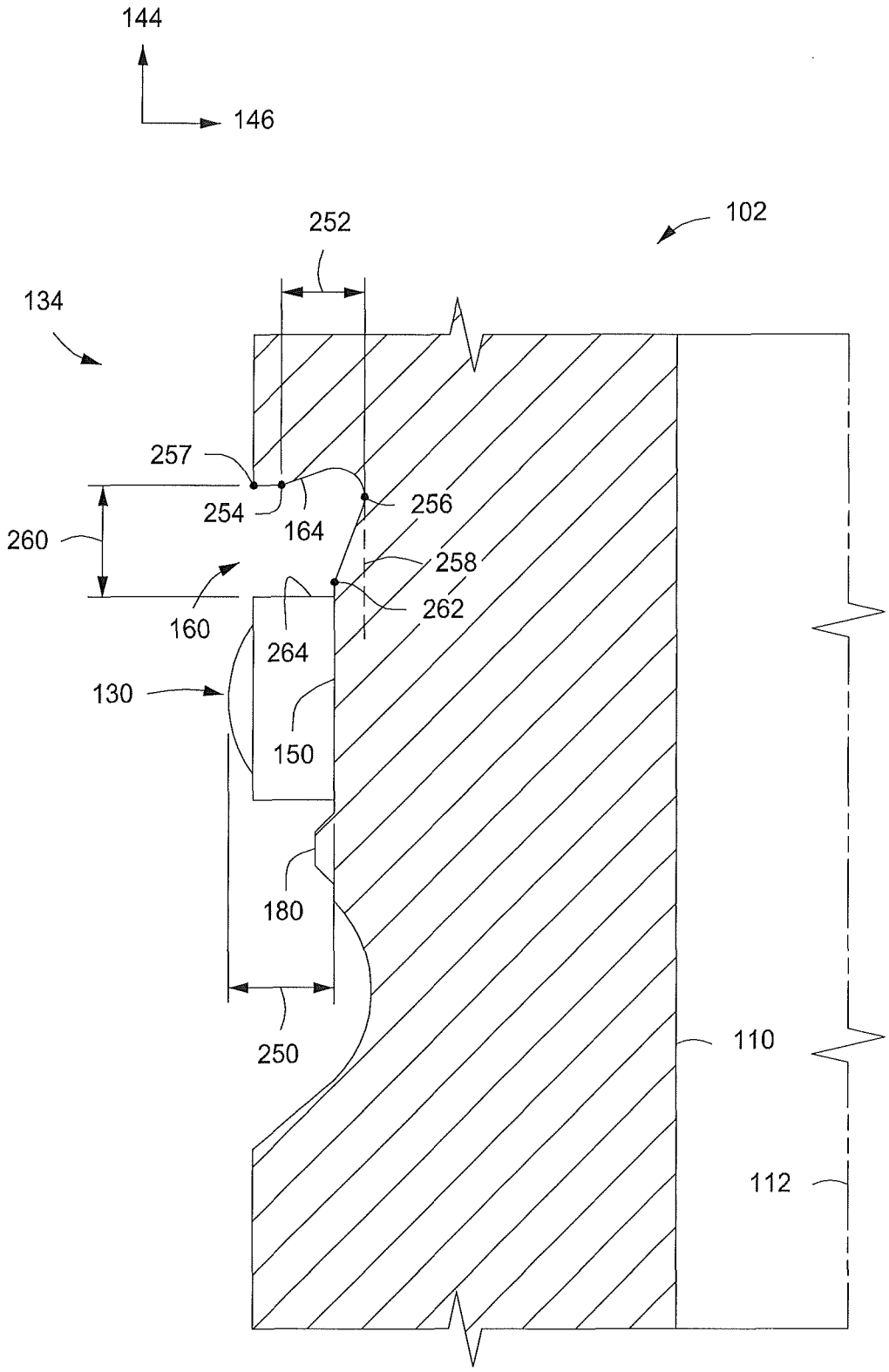
FIG. 6 shows a cross sectional view of a portion of the cylinder liner annotated as Detail 4 in FIG. 3 assembled with an upper seal, according to an aspect of the disclosure.

FIG. 4 shows a cross sectional view of a portion of the cylinder liner 102 annotated as Detail 4 in FIG. 3, according to an aspect of the disclosure. The radially external surface 134 of the cylinder liner 102 includes an undercut seal trap 160 disposed between the upper sealing surface 150 and the proximal end 140 (see FIG. 3) of the cylinder liner 102. The undercut seal trap 160 may be disposed adjacent to the upper sealing surface 150. According to an aspect of the disclosure, adjacent arrangement of the undercut seal trap 160 and the upper sealing surface 150 means that the undercut seal trap 160 abuts the upper sealing surface 150. According to another aspect of the disclosure, adjacent arrangement of the undercut seal trap 160 and the upper sealing surface 150 still contemplates the possibility of an intervening surface, such as a chamfer, a fillet, a miter, and the like, wherein the undercut seal trap 160 remains proximate to the upper sealing surface 150. According to another aspect of the disclosure, as shown in FIG. 6, the undercut seal trap 160 extends from a radially outermost point 254 of the undercut seal trap 160 to a proximal end 262 of the upper sealing surface 150.

Returning to FIG. 4, the undercut seal trap 160 may include a first surface 164 and a second surface 166. The first surface 164, the second surface 166, or both, may include or consist entirely of surfaces of revolution about the longitudinal axis 112. The first surface 164 at least partly faces the longitudinal axis 112, such that a vector 168 extending perpendicular to the first surface 164 has a component in the radial direction 146 pointing toward the longitudinal axis 112. The second surface 166 at least partly faces away from the longitudinal axis 112, such that a vector 170 extending perpendicular to the second surface 166 has no component along the radial direction 146 pointing toward the longitudinal axis 112.

The first surface 164 at least partly faces the distal end 142 (see FIG. 3) of the cylinder liner 102 along the longitudinal direction 144, such that the vector 168 has a component along the longitudinal direction 144 pointing toward the distal end 142 of the cylinder liner 102. Stated differently, the vector 168 has a component along the longitudinal direction 144 extending from the undercut seal trap 160 toward the upper sealing surface 150. The second surface 166 at least partly faces the proximal end 140 (see FIG. 3)

of the cylinder liner 102 along the longitudinal direction 144, such that the vector 170 has a component along the longitudinal direction 144 pointing toward the proximal end 140 of the cylinder liner 102.

According to an aspect of the disclosure, the first surface 164 at least partly faces the second surface 166, such that the vector 168 intersects the second surface 166 at a point 172. According to another aspect of the disclosure, the second surface 166 at least partly faces the first surface 164, such that the vector 170 intersects the first surface 164 at a point 174. According to another aspect of the disclosure, the second surface 166 includes a point 176 that does not face the first surface 164, such that a vector 178 extending perpendicular to the second surface 166 at the point 176 does not intersect the first surface 164 at any point.

According to an aspect of the disclosure, the first surface 164 is arranged adjacent to the second surface 166. Alternatively or additionally, both the first surface 164 and the second surface 166 may be arranged along the radially external surface 134 of the cylinder liner between the upper sealing surface 150 and the proximal end 140 (see FIG. 3) of the cylinder liner 102. According to an aspect of the disclosure, adjacent arrangement of the first surface 164 and the second surface 166 means that the first surface 164 abuts the second surface 166. According to another aspect of the disclosure, adjacent arrangement of the first surface 164 and the second surface 166 still contemplates the possibility of an intervening surface, such as the concave surface 179, within the undercut seal trap 160.

Referring still to FIG. 4, the radially external surface 134 of the cylinder liner 102 may also include a radial protrusion 180. The radial protrusion 180 may be disposed adjacent to the upper sealing surface 150 opposite the undercut seal trap 160 along the longitudinal direction 144. A radial distance 182 between the radial protrusion 180 and the longitudinal axis 112 is greater than a radial distance 184 from the upper sealing surface 150 to the longitudinal axis 112. The radially external surface 134 of the cylinder liner 102 may further include a concave surface 186.

According to an aspect of the disclosure, all of the second surface 166 may be disposed at a radial distance 188 from the longitudinal axis 112 that is less than or equal to a radial distance 184 from the upper sealing surface 150 to the longitudinal axis 112. According to another aspect of the disclosure, all of the second surface 166 may be disposed at a radial distance 188 from the longitudinal axis 112 that is less than or equal to a radial distance 184 from any point along the upper sealing surface 150.

According to an aspect of the disclosure, at least a portion of the first surface 164 is disposed at a radial distance 190 from the longitudinal axis 112 that is less than or equal to the radial distance 184 from the upper sealing surface 150 to the longitudinal axis 112. Alternatively or additionally, at least a portion of the first surface 164 is disposed at another radial distance 190 from the longitudinal axis that is greater than the radial distance 184 from the upper sealing surface 150 to the longitudinal axis 112.

Referring still to FIG. 4, the undercut seal trap 160 may further include a third surface 192 disposed between the first surface 164 and the proximal end 140 (see FIG. 3) of the cylinder liner 102. The third surface 192 may at least partly face the distal end 142 (see FIG. 3) of the cylinder liner 102 along the longitudinal direction 144. According to an aspect of the disclosure, the third surface 192 faces exclusively in the longitudinal direction 144 toward the distal end 142 (see FIG. 3) of the cylinder liner 102. According to another aspect of the disclosure, the third surface 192 may be disposed adjacent to the first surface 164.

Figure 5:
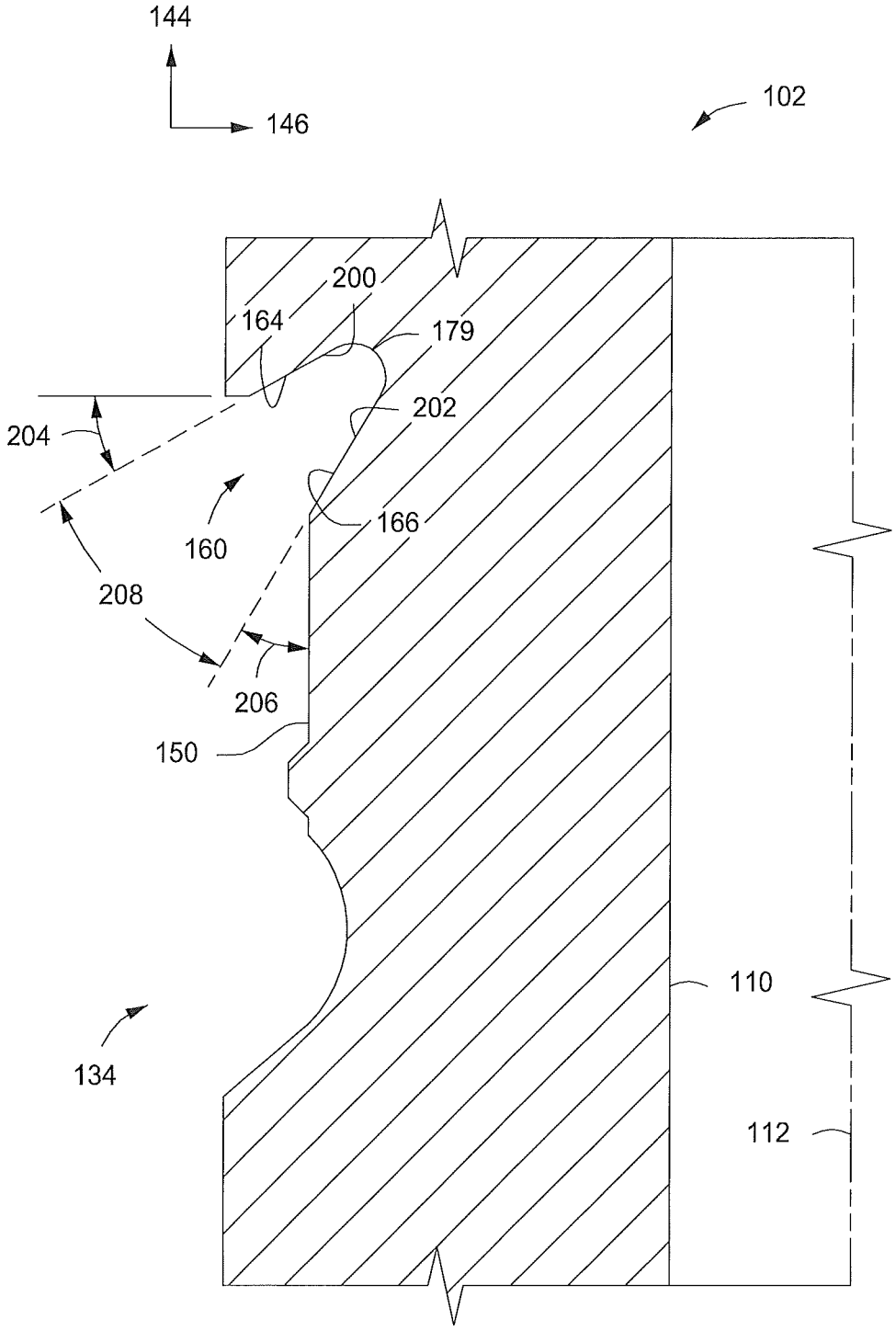
FIG. 5 shows a cross sectional view of a portion of the cylinder liner annotated as Detail 4 in FIG. 3, according to an aspect of the disclosure.

FIG. 5 shows a cross sectional view of a portion of the cylinder liner 102 annotated as Detail 4 in FIG. 3, according to an aspect of the disclosure. As shown in FIG. 5, a first frustoconical surface 200 may compose at least a portion of the first surface 164. Alternatively or in addition, a second frustoconical surface 202 may compose at least a portion of the second surface 166. The first frustoconical surface 200, the second frustoconical surface 202, or both, may have an axis of revolution that is coaxial with the longitudinal axis 212. The concave surface 179 may be disposed between the first frustoconical surface 200 and the second frustoconical surface 202 along the radially external surface 134.

According to an aspect of the disclosure, the first frustoconical surface 200 forms an angle 204 with the radial direction 146, in the plane defined by the longitudinal direction 144 and the radial direction 146, that ranges from about 12 degrees to about 23 degrees. According to another aspect of the disclosure, the angle 204 ranges from about 16 degrees to about 19 degrees. According to yet another aspect of the disclosure, the angle 204 is about 17.5 degrees.

According to an aspect of the disclosure, the second frustoconical surface 202 forms an angle 206 with the longitudinal direction 144, in the plane defined by the longitudinal direction 144 and the radial direction 146, that ranges from about 12 degrees to about 23 degrees. According to another aspect of the disclosure, the angle 206 ranges from about 16 degrees to about 19 degrees. According to yet another aspect of the disclosure, the angle 206 is about 17.5 degrees.

According to an aspect of the disclosure, the first frustoconical surface 200 forms an angle 208 with the second frustoconical surface 202, in the plane defined by the longitudinal direction 144 and the radial direction 146, that ranges from about 44 degrees to about 66 degrees. According to another aspect of the disclosure, the angle 208 ranges from about 52 degrees to about 58 degrees. According to yet another aspect of the disclosure, the angle 208 is about 55 degrees. However, it will be appreciated that the angles 204, 206, and 208 may assume other values to yield desired results in other configurations.

FIG. 6 shows a cross sectional view of a portion of the cylinder liner 102 annotated as Detail 4 in FIG. 3 assembled with an upper seal 130, according to an aspect of the disclosure. As shown in FIG. 5, the upper seal 130 is disposed on the upper sealing surface 150 of the cylinder liner 102. The upper seal 130 may be formed in the shape of a band, and wrap around a circumference of the cylinder liner 102. The upper seal 130 may be formed of an elastomeric material, a graphite-foil composite material, a resilient or crushable metal seal, or any other seal material known to persons having skill in the art. The upper seal 130 has an uncompressed thickness 250 in the radial direction 146.

A depth 252 of the undercut seal trap 160 may be less than or equal to 90% of the uncompressed thickness 250 of the upper seal 130. Alternatively, the depth 252 of the undercut seal trap 160 may be less than or equal to 85% of the uncompressed thickness 250 of the upper seal 130. However, it will be appreciated that the undercut seal trap 160 may assume other depths 252 relative to the uncompressed thickness 250 of the upper seal 130 to yield desired results in other configurations.

According to an aspect of the disclosure, the depth 252 of the undercut seal trap 160 is defined as a radial distance between a radially outermost point 254 on the first surface 164 and a radially innermost point 256 on the undercut seal trap 160. According to another aspect of the disclosure, the radially innermost point 256 is tangent to a line 258 parallel to the longitudinal axis 112. However, it will be appreciated that the depth 252 of the undercut seal trap 160 may be defined in different ways for different configurations within the scope of the present disclosure. For example, the depth 252 of the undercut seal trap 160 may alternatively be defined as a radial distance between a radially outermost point 257 on the undercut seal trap 160 and the radially innermost point 256 on the undercut seal trap 160.

A height 260 of the of the undercut seal trap 160 may be less than or equal to the uncompressed thickness 250 of the upper seal 130. According to an aspect of the disclosure, the height 260 of the undercut seal trap 160 is defined as a longitudinal distance between a proximal end 262 of the upper sealing surface 150 and the radially outermost point 254 on the first surface 164. According to another aspect of the disclosure the height 260 of the undercut seal trap 160 is defined as a longitudinal distance between the proximal end 262 of the upper sealing surface 150 and the radially outermost point 257 of the undercut seal trap 160.

INDUSTRIAL APPLICABILITY

The present disclosure is applicable to reciprocating piston engines or reciprocating piston compressors having removable cylinder liners, or any other machine having a removable cylinder liner installed in a block. Reciprocating piston engines according to the present disclosure include steam engines, internal combustion engines, or other reciprocating piston engines known in the art. Reciprocating internal combustion engines contemplated by the present disclosure include compression ignition engines, spark ignition engines, or any other reciprocating internal combustion engines known to persons having skill in the art.

The engine 100 may be incorporated into a machine for operation thereof. The machine can be an "over-the-road" vehicle such as a truck used in transportation or may be any other type of machine that performs some type of operation associated with an industry such as mining, construction, farming, transportation, or any other industry known in the art. For example, the machine may be an off-highway truck, earth-moving machine, such as a wheel loader, excavator, dump truck, backhoe, motor grader, material handler or the like. The term "machine" can also refer to stationary equipment like an electrical generator, a pump, a compressor, a material handling system, or the like, that is driven by shaft power from the engine 100.

Referring to FIGS. 1 and 6, a cylinder liner 102 may be installed in a bore 122 of a block 104, at least in part, by installing a seal 130 onto the upper sealing surface 150 of the cylinder liner 102, and inserting the distal end 142 (see FIG. 2) of the cylinder liner 102 into the bore 122 of the block 104 until the flange 126 seats on the upper deck surface 128 of the block and the upper seal 130 is disposed in sealing contact with both the upper sealing surface 150 of the cylinder liner 102 and the internal surface 124 of the block 104. After the seal 130 is installed on the upper sealing surface 150 of the cylinder liner 102, the radial protrusion 180 and the undercut seal trap 160 may limit longitudinal translation of the upper seal 130 relative to the cylinder liner 102.

In some applications, while inserting the cylinder liner 102 into the block 104, shearing or frictional force acting between the internal surface 124 of the block 104 and the seal 130, may cause the upper seal 130 to translate in the longitudinal direction 144 relative to the cylinder liner 102 toward the proximal end 140 (see FIG. 3) of the cylinder liner 102. In turn, the undercut seal trap 160 may direct a proximal end 264 of the seal 130 radially toward the longitudinal axis 112, and away from a gap between the cylinder liner 102 and the internal surface 124 of the block 104, thereby promoting seal 130 life and integrity by avoiding pinching of the upper seal 130 between the internal surface 124 of the block 104 upon assembly.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A cylinder liner for an engine, the cylinder liner comprising:

a cylindrical wall having a radially internal surface and a radially external surface opposite the radially internal surface, the cylindrical wall defining a longitudinal axis therethrough, the radially external surface including a sealing surface and an undercut surface adjacent to the sealing surface, the sealing surface at least partly facing away from the longitudinal axis, the undercut surface including a first surface and a second surface, the first surface at least partly facing the longitudinal axis, and the second surface at least partly facing away from the longitudinal axis, wherein a radial distance from the first surface to the longitudinal axis is less than a radial distance from the sealing surface to the longitudinal axis.

2. The cylinder liner of claim 1, wherein the first surface at least partly faces a first longitudinal direction, the first longitudinal direction extending along the longitudinal axis in a direction from the undercut surface toward the sealing surface.

3. The cylinder liner of claim 2, wherein the second surface at least partly faces a second longitudinal direction, the second longitudinal direction being opposite the first longitudinal direction.

4. The cylinder liner of claim 1, wherein a portion of the first surface faces the second surface.

5. The cylinder liner of claim 4, wherein a first portion of the second surface faces the first surface.

6. The cylinder liner of claim 5, wherein a second portion of the second surface does not face the first surface.

7. The cylinder liner of claim 1, wherein a first frustoconical surface composes at least a portion of the first surface.

8. The cylinder liner of claim 7, wherein a second frustoconical surface composes at least a portion of the second surface.

9. The cylinder liner of claim 1, wherein the radially external surface further includes a radial protrusion disposed adjacent to the sealing surface, the radial protrusion is disposed opposite the undercut surface with respect to the sealing surface along a direction parallel to the longitudinal axis, and a radial distance from the radial protrusion to the longitudinal axis is greater than the radial distance from the sealing surface to the longitudinal axis.

10. The cylinder liner of claim 1, wherein a radial distance from the second surface to the longitudinal axis is less than the radial distance from the sealing surface to the longitudinal axis.

11. A cylinder liner assembly, comprising:

a cylindrical wall having a radially internal surface and a radially external surface opposite the radially internal surface, the cylindrical wall defining a longitudinal axis therethrough, the radially external surface including a sealing surface and an undercut surface adjacent to the sealing surface, the sealing surface at least partly facing away from the longitudinal axis, the undercut surface including a first surface and a second surface, the first surface at least partly facing the longitudinal axis, and the second surface at least partly facing away from the longitudinal axis, wherein a radial distance from the first surface to the longitudinal axis is less than a radial distance from the sealing surface to the longitudinal axis; and a seal disposed on the sealing surface.

12. The cylinder liner assembly of claim 11, wherein an undercut depth is less than or equal to 90% of an uncompressed thickness of the seal along a radial direction normal to the longitudinal axis.

13. The cylinder liner assembly of claim 12, wherein the undercut depth is less than or equal to 85% of the uncompressed thickness of the seal along the radial direction normal to the longitudinal axis.

14. The cylinder liner assembly of claim 12, wherein the undercut depth extends in a radial direction from a radially outermost point on the first surface to a radially innermost point on the undercut surface, the radial direction being normal to the longitudinal axis.

15. The cylinder liner assembly of claim 14, wherein the radially innermost point on the undercut surface is a tangent point between a line parallel to the longitudinal axis and the undercut surface.

16. An engine, comprising:

a block;

a cylinder liner disposed within the block, a radially external surface of the cylinder liner at least partly facing the block, the cylinder liner defining a longitudinal axis therethrough;

a piston disposed within the cylinder liner and configured for reciprocal sliding engagement with a radially internal surface of the cylinder liner along the longitudinal axis, the radially internal surface being opposite the radially external surface, the radially external surface of the cylinder liner including a sealing surface and an undercut surface adjacent to the sealing surface, the sealing surface at least partly facing away from the longitudinal axis, and the undercut surface including a first surface and a second surface, the first surface at least partly facing the longitudinal axis, and the second surface at least partly facing away from the longitudinal axis, wherein a radial distance from the first surface to the longitudinal axis is less than a radial distance from the sealing surface to the longitudinal axis; and a seal disposed in sealing engagement with the sealing surface and the block.

17. The engine of claim 16, wherein an undercut depth is less than or equal to 90% of an uncompressed thickness of the seal along a radial direction normal to the longitudinal axis.

18. The engine of claim 17, wherein the undercut depth extends in a radial direction from a radially outermost point on the undercut surface to a radially innermost point on the undercut surface, the radial direction being normal to the longitudinal axis.

* * * * *